US008387857B2

(12) United States Patent
Messerschmid

(10) Patent No.: US 8,387,857 B2
(45) Date of Patent: Mar. 5, 2013

(54) OUTER SLEEVE FOR A DOUBLE WALLED CUP AND A PROCESS FOR MANUFACTURING SAME

(75) Inventor: Uwe Messerschmid, Albershausen (DE)

(73) Assignee: PTM Packaging Tools Machinery Pte. Ltd., Singapore (SG)

( * ) Notice: Subject to any disclaimer, the term of this patent is extended or adjusted under 35 U.S.C. 154(b) by 357 days.

(21) Appl. No.: 12/454,727

(22) Filed: May 21, 2009

(65) Prior Publication Data

US 2009/0294456 A1 Dec. 3, 2009

(30) Foreign Application Priority Data

May 28, 2008 (DE) ..... 10 2008 026 984

(51) Int. Cl.
*B65D 3/00* (2006.01)
*A47J 39/00* (2006.01)

(52) U.S. Cl. ..... 229/403; 229/400; 220/737; 220/738; 220/592.17

(58) Field of Classification Search ..... 220/739, 220/592.17, 592.19, 62.12, 62.18, 62.19, 220/737, 738; 229/403, 400
See application file for complete search history.

(56) References Cited

U.S. PATENT DOCUMENTS

| | | | | |
|---|---|---|---|---|
| 2,816,697 | A | 12/1957 | Amberg | |
| 6,068,182 | A * | 5/2000 | Tokunaga | 229/403 |
| 6,193,098 | B1 * | 2/2001 | Mochizuki et al. | 220/592.17 |
| 6,260,756 | B1 * | 7/2001 | Mochizuki et al. | 229/402 |
| 6,364,201 | B1 | 4/2002 | Varano | |
| 7,451,910 | B2 * | 11/2008 | Frost et al. | 229/400 |
| 7,481,356 | B2 | 1/2009 | Stahlecker | |
| 7,677,435 | B2 * | 3/2010 | Stahlecker | 229/403 |
| 7,717,325 | B2 * | 5/2010 | Puls et al. | 229/403 |
| 2006/0118608 | A1 | 6/2006 | Stahlecker | |
| 2008/0023536 | A1 | 1/2008 | Frost et al. | |
| 2008/0023537 | A1 | 1/2008 | Frost et al. | |
| 2008/0029588 | A1 | 2/2008 | Messerschmid et al. | |
| 2009/0159653 | A1 | 6/2009 | Stahlecker | |

FOREIGN PATENT DOCUMENTS

| | | | |
|---|---|---|---|
| DE | 10 2006 025 612 | A1 | 11/2007 |
| DE | 102007030664 | A1 | 1/2008 |
| EP | 1 900 651 | A1 | 3/2008 |
| GB | 393 640 | | 6/1933 |
| GE | 2 420 267 | A | 5/2006 |
| JP | 2001002052 | A | 1/2001 |

(Continued)

OTHER PUBLICATIONS

German Patent Office Search Report dated Jan. 29, 2009 (4 pages).

(Continued)

*Primary Examiner* — Mickey Yu
*Assistant Examiner* — Chun Cheung
(74) *Attorney, Agent, or Firm* — Flynn, Thiel, Boutell & Tantis, P.C.

(57) ABSTRACT

An outer sleeve for a double-walled cup and a process for manufacturing the outer sleeve are described, in which a flat-lying blank made from a paper material is joined in a tube shape by means of the overlapping of two longitudinal edges of the blank, and in which the outer sleeve in this form is provided with an inwardly rolled curled part. The curled-in part is glued or sealed onto the inside of outer sleeve in the area of the overlap.

14 Claims, 3 Drawing Sheets

FOREIGN PATENT DOCUMENTS

| | | | |
|---|---|---|---|
| JP | 2003-312635 | * | 11/2003 |
| JP | 2003312635 | A | 11/2003 |
| JP | 2003-128038 | A | 5/2008 |
| RU | 2319650 | | 3/2008 |
| WO | WO 00/17058 | | 3/2000 |

OTHER PUBLICATIONS

Eurasian Patent Office Search Report dated Sep. 23, 2009 (2 pages).
European Patent Office Search Report dated Sep. 28, 2009 (6 pages).

* cited by examiner

OUTER SLEEVE FOR A DOUBLE WALLED CUP AND A PROCESS FOR MANUFACTURING SAME

BACKGROUND AND SUMMARY OF THE INVENTION

An outer sleeve for a double walled cup and a process for manufacturing same The present invention relates to an outer sleeve for a double walled cup, which is formed from a blank made of paper material and which is provided with an inwardly rolled curled part, whereby the blank is joined to form a tube shape by means of an overlap of two longitudinal edges of the blank.

The present invention relates further to a process for manufacturing such outer sleeves.

Outer sleeves of the above mentioned type are applied in large numbers in manufacturing in order to improve the insulating properties of paper cups. By applying the outer sleeve to a cup made of paper material, a double-walled insulating cup having an essentially ring-shaped hollow space between the inner sleeve and the outer sleeve of the cup is formed, which lends the cup good insulating properties. In order to ensure a sufficiently large gap between the inner sleeve and the outer sleeve, it is common practice to apply at least one inwardly rolled curled part on the outer sleeve. This curled part can be designed in a variety of ways.

In the manufacture of the outer sleeve, a flat-lying blank made of a paper material is joined by means of overlapping two longitudinal edges of the blanks. An inwardly rolled curled part is then applied to the so formed outer sleeve. The pre-manufactured outer sleeve is subsequently slid in axial direction onto the also pre-manufactured cup and attached thereto. A double-walled cup is thus formed.

It can happen that the outer sleeve with the inwardly rolled curled part catches on the skirt of the inner cup when the outer sleeve is slid axially onto the inner cup sleeve.

It is an object of the present invention to create an outer sleeve for a double-walled cup which does not easily catch on the inner cup when slid on.

This object has been achieved in that the curled part is glued or sealed onto the inside of the outer sleeve at least in the area of the overlap.

Because of the enlarged thickness of the outer sleeve in the area of the overlap, the resilient properties are particularly strong in this area. In the case of relatively stiff paper material, the inwardly rolled curled part at the outer sleeve in the area of the overlap is not formed exactly, but rather has the tendency to unroll because of the stiffness of the paper material. The inner diameter of the outer sleeve within the curled part is as a result reduced in the area of the overlap and can lead to catching of the outer sleeve on the skirt of the inner cup when the outer sleeve is axially slid onto the inner cup. Gluing or sealing of the curled part in the area of the overlap effectively prevents the curled part from partly unrolling again. The catching of the outer sleeve when being slid onto the inner cup due to an insufficiently clear inner diameter in the area of the curled part can be effectively prevented.

Gluing or sealing of the curled part on the inside of the outer sleeve is particularly advantageous when the curled part comprises an area extending parallel to the outer sleeve, in which the material of the curled part lies plane with the inner side of the outer sleeve.

A non-coated paper material is frequently used for the outer sleeve, as the outer sleeve does not come into contact with the liquid which is poured into the cup. In the application of a non-coated paper material, a stripe of glue is applied to the longitudinal edge of the blank before the blank is joined to a tube-shape. Various types of glue can be used. Suitable are for example cold glue, hot glue or in particular a hot-melt adhesive ("Hot-Melt").

For certain applications it can be advantageous to manufacture the outer sleeve from a paper material which is coated on at least one side, for example a polyethylene coating. The curled part can be sealed on the inside of the outer sleeve by means of heating the synthetic coating. Sealing or gluing of the curled part can also be carried out circumferentially along the entire circumference of the outer sleeve.

For the efficient manufacture of the outer sleeve it is advantageous when the blank comprises a recess on a longitudinal edge which recess comes to lie in the area of the overlap. The recess is so designed that in the overlapping of the two longitudinal edges, a section of the stripe of glue is not covered. When forming the inwardly curled part, the uncovered section of the stripe of glue serves to glue the curled part in the area of the overlap inside on the outer sleeve.

The recess of the blank in the area of the overlap is advantageously so designed that the curled part in an area of the overlap leads to an overall thickness of the outer sleeve which corresponds approximately to three times the material thickness of the blank. In contrast to a standard minimum of four times the material thickness in the area of the overlap, the overall reduced thickness in the area of the overlap also reduces the risk of the outer sleeve catching on the inner cup while being slid thereon.

The outer sleeve according to the present invention is particularly suitable for cups which have an essentially truncated cone shape. Accordingly, the outer sleeve can also be conically designed. The glued or sealed on curled part on the inside of the outer sleeve is hereby applied to that end of the outer sleeve which has the smaller circumference. An outer sleeve according to the present invention is however not just suitable for cups made of paper material, but rather can be applied as an outer sleeve for cups made of synthetic material.

Furthermore an outer sleeve according to the present invention is particularly suitable for an inner cup comprising a widening on its skirt, whereby a lower edge of the widening forms a standing base for the cup. In the case of inner cups having a widened skirt, the sliding on of an outer sleeve is particularly critical, as the diameter enclosing the widening can be as large or even larger than the inner diameter of the curled part of the outer sleeve. Even in the case of such inner cups, an outer sleeve according to the present invention can effectively prevent the outer sleeve catching when being axially slid on to the inner cup.

BRIEF DESCRIPTION OF THE DRAWINGS

These and further objects, features and advantages of the present invention will become more readily apparent from the following detailed description thereof when taken in conjunction with the accompanying drawings. Individual features of the various embodiments shown and described can be combined optionally without exceeding the scope of the present invention wherein.

DETAILED DESCRIPTION OF THE DRAWINGS

Figure 1:
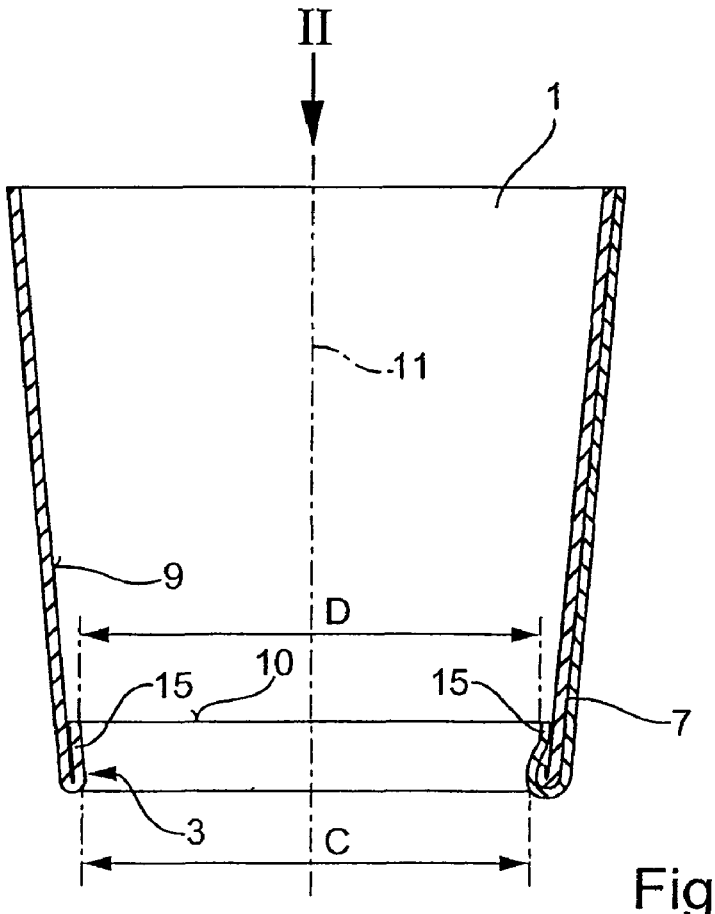
FIG. 1 is an outer sleeve according to the present invention for a double-walled cup in longitudinal section.
Figure 2:
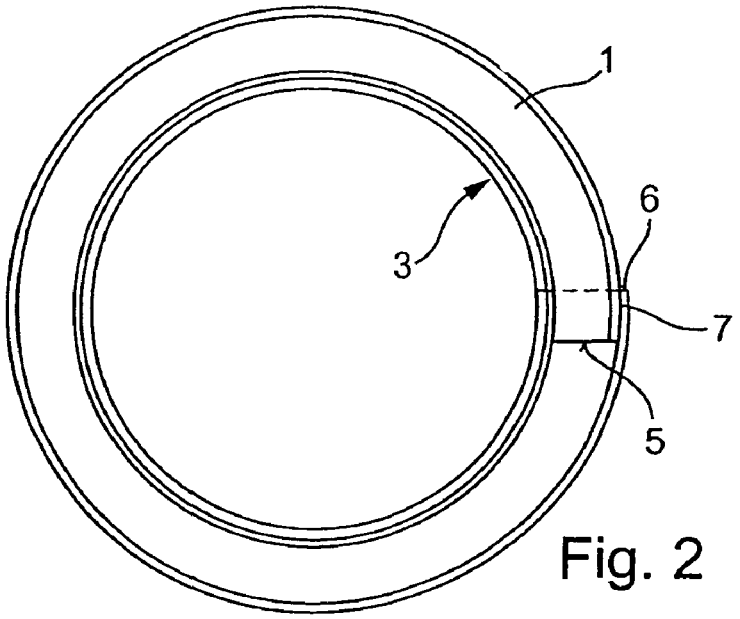
FIG. 2 is a top view in the direction of the arrow II of FIG. 1 of the outer sleeve.

In the FIGS. 1 and 2 an outer sleeve 1 for a double-walled cup 2 is shown. The double-walled cup 2 is described in greater detail below with the aid of FIG. 5. The outer sleeve 1 consists of a paper material and comprises a tube-shaped conical form. On the end with the smaller circumference, an inwardly rolled curled part 3 is applied.

Figure 3:
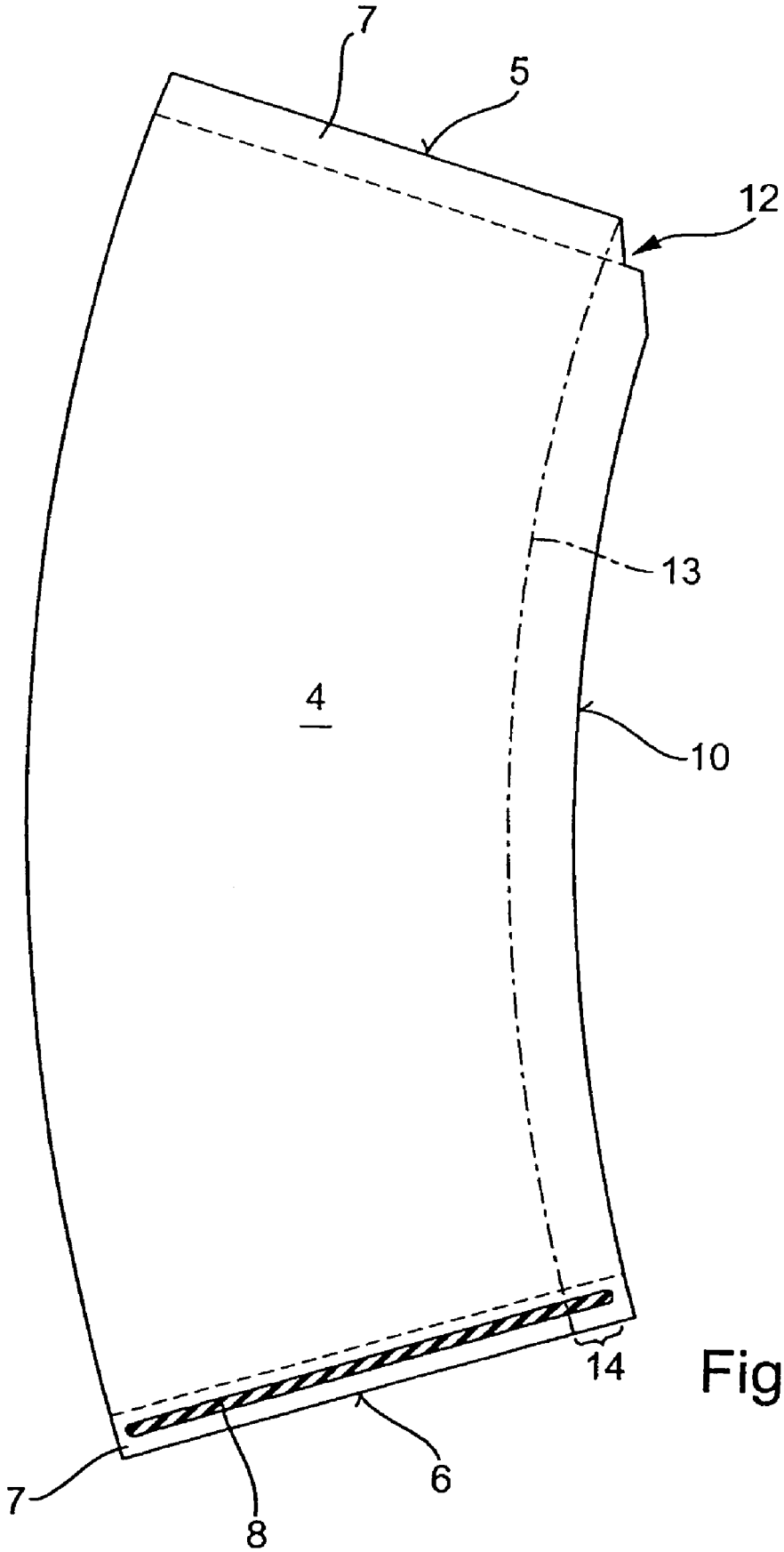
FIG. 3 is a flat-lying blank for an outer sleeve as shown in FIG. 1.

The outer sleeve 1 is formed from a blank 4 made of paper material. The flat lying blank 4 forming the primary material for the outer sleeve 1 is shown in FIG. 3. The blank 4 has essentially the shape of a segment of a circular ring. The blank comprises two longitudinal edges 5 and 6 which are joined together by means of the formation of an overlap 7, so that the tube-shaped outer sleeve 1 is created. A stripe of glue 8 is applied on the flat-lying blank 4 on the longitudinal edge 6 for the purposes of joining the longitudinal edge 5 and 6 in the area of the overlap 7. The stripe of glue 8 is applied to the side of the blank 4 which subsequently forms the inner side 9 of the outer sleeve 1. The flat-lying blank 4 is placed around a conical mandrel (not shown) subsequent to the application of the stripe of glue 8. When the blank 4 is placed around the mandrel, the longitudinal edge 6 comprising the stripe of glue 8 is laid on the longitudinal edge 5 and pressed thereon, so that the overlap 7 is created. The curled part 3 is then subsequently formed by means of a forming tool (not shown). The circular-shaped edge 10 of the outer sleeve 1 is turned over towards the inside and attached to the inner side 9 by means of the forming tool placed parallel to the middle axis 11 of the outer sleeve 1.

According to the present invention it is provided that the curled part 3 is glued on to the inner side 9 in the area of the overlap 7. A recess 12 is provided on the longitudinal edge 5 of the blank 4, which recess 12 comes to lie in the area of the overlap 7. The recess 12 can be seen in FIG. 3. The recess 12 is designed in such a way that it extends close to the folding line 13 for the curled part 3. The stripe of glue 8 on the longitudinal edge 6 is applied beyond the folding line 13 to the area of the blank 4 which subsequently forms the curled part 3. By means of the recess 12, a section 14 of the stripe of glue is not covered during the formation of the overlap 7 of the two longitudinal edges 5 and 6. The uncovered section 14 of the stripe of glue 8 is located in the area of the blank 4 which subsequently forms an area 15 of the curled part 3 extending parallel to the outer sleeve 1. The uncovered section 14 of the stripe of glue 8 is located between the folding line 13 for the curled part 3 and the edge 10. When the inwardly rolled curled part 3 is formed, as shown in FIG. 1, the uncovered section 14 of the stripe of glue 8 comes to lie against the inner side 9 of the outer sleeve 1 and glues on the curled part 3 in the area of the overlap 7 on the inside of the outer sleeve 1.

The recess 12 has the advantage in that the gluing on of the curled part 3 on the inside 9 of the outer sleeve 1 can be realized without additional procedural steps and without any additional application of glue. The recess 12 also has the advantage in that the curled part 3 only has, in the area of the overlap 7, an overall thickness which is approximately three times the material thickness of the blank. The curled part 3 is thus only marginally thicker in the area of the overlap 7 than in the remaining areas of the circumference of the edge 10. As a result, a practically constant sized inner diameter C is ensured in the area of the curled part 3.

Figure 4:
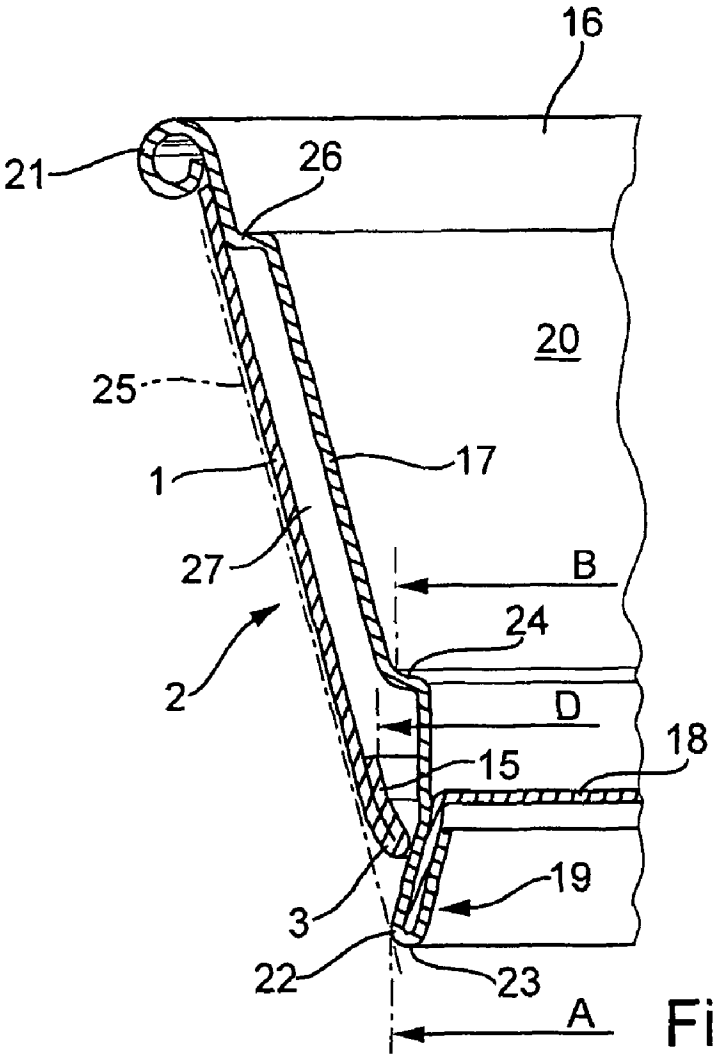
FIG. 4 shows a section of the longitudinal section of a double-walled cup comprising an outer sleeve as shown in FIG. 1.

A double-walled cup 2 is shown in FIG. 4 which comprises an outer sleeve 1 of the present invention. The outer sleeve 1 is applied to a pre-manufactured inner cup 16. The inner cup 6 comprises essentially a conical sleeve 17, which in relation to the double-walled cup 2 is also denoted as an inner sleeve, and a cup-shaped bottom 18. The open side of the cup-shaped bottom 18 is arranged in such a way that it is facing away from the filling opening of the cup 2. The bottom 3 is joined in a liquid-tight way by its wall in the area of the smallest circumference of the sleeve 17 to same by means of the formation of a skirt 19. The material of the sleeve 17 is folded over around the wall of the bottom 3 in the area of the skirt 19 and folded inwards. The sleeve 17 and the bottom 18 form an inner space 20 of the cup 2, which inner space can be filled with liquid. The sleeve 17 enclosing the inner space 20 comprises an outwardly rolled lip 21 on its upper edge, that is, in the largest circumferential area. The inner cup 16 advantageously has a round cross section and thus an essentially truncated cone shape.

The skirt 19 comprises at least in one area along its circumference an outwardly projecting widening 22. A widening can be understood in the sense that the skirt 19 is positioned outwards in relation to a circular cylinder around the middle axis of the inner cup 16, so that the skirt 19 encloses a cross sectional area which increases downwards towards the standing surface. A lower edge 23 of the widening 22 on the skirt 19 forms the standing surface for the cup 2. The cup 2 stands during use on its standing surface, which is increased by the widening 22. This prevents the cup 2 from tipping over. The widening 22 is advantageously designed circumferentially around the circumference of the skirt 19. The outer diameter enclosing the widening 22 is denoted as diameter A.

It can be provided that the sleeve defining the inner space 20 comprises a rib or a bead 24, which can take up the forces acting in the direction of the middle axis of the cup 2, that is the forces which act between two cups when stacked. A diameter B in the area of the bead 24 is adapted to the diameter A of the widening 22 at the skirt 19, so that the lower edge 23 of a first cup 2 is supported on the bead 24 of a second cup 2 and ensuring a stable stacking of a number of identical cups 2. Even when very strong forces occur in the direction of the middle axis of the cup 2, one cup does not catch in another cup, so that an easy removal of the cup when de-stacked is ensured.

In order that the outer sleeve 1 does not impair the stacking properties of the double-walled cup 2 it is provided that the outer contour of the outer sleeve 1 is located within a parallel 25 to the inner sleeve 17, whereby the parallel 25 is applied to the widening 22 of the skirt 19.

The inner sleeve 18 comprises in the area of the lip 21 a sudden change in size in the form of a shoulder 26, which represents a discontinuous cross section increase as seen from the bottom 18 to the lip 21. Due to the shoulder 26, an essentially ring-shaped hollow space 27 is formed between the inner sleeve 17 and the outer sleeve 1, which provides the double-walled cup 2 with very good heat insulation. The outer sleeve 1 lies in the area between the lip 21 and the shoulder 26 on the inner sleeve 17 and can be attached there, for example by means of sealing or gluing. The curled part 3 applied to the bottom edge of the outer sleeve 1 lies with its smallest diameter C on the inner cup 16.

It is provided that the smallest diameter C of the curled part 3 is smaller than the diameter A of the widening 22 on the skirt 19. In the manufacture of the double-walled cup 2, the prefabricated outer sleeve is slid from below in axial direction onto an inner cup 16, also prefabricated. The paper material of the inner cup 16 and the paper material of the outer sleeve 1 are sufficiently flexible to permit the outer sleeve 1 with its smallest diameter C at the curled part 3 to be slid over the diameter A of the widening 22 without incurring any damage.

In order that the curled part 3 of the outer sleeve 1 does not catch at the lower edge 32 of the widening 22 on the skirt 19, the area 15 of the curled part 3 extending parallel to the outer sleeve 1 is provided. The diameter of the upper edge of the curled part 3 is denoted by the reference letter D and is larger than the diameter A at the widening 22. It is also provided, in accordance with the present invention, that the curled part 3 is glued on in the area of the overlap 7 on the inner side 9 of the outer sleeve 1. The gluing of the curled part 3 in the area of the overlap 8 prevents the curled part 3 from unrolling again slightly in the area of the overlap 7 and also prevents the area 15 of the curled part 3 from not lying close to the inner side 9.

In gluing the curled part 3 in the area of the overlap 7, the outer sleeve 1 is effectively prevented from catching when slid onto the inner cup 16, thus the speed of production in the manufacture of double-walled cups 2 can be increased.

Figure 5:
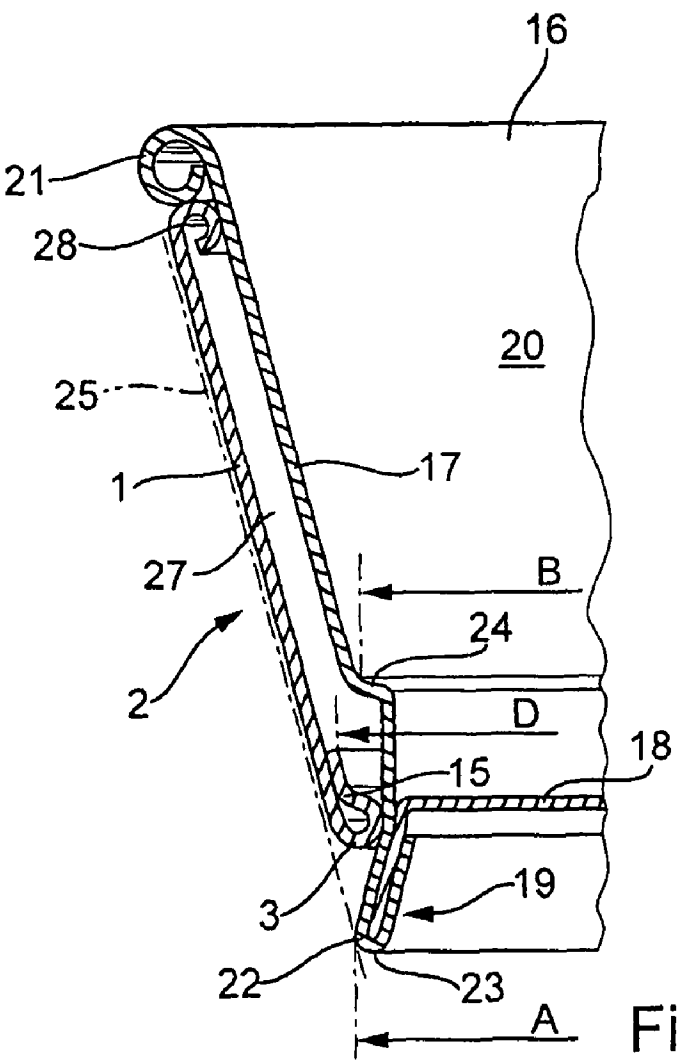
FIG. 5 shows a view similar to FIG. 4 of a variation of a double-walled cup.

In FIG. 5 a variation of a double-walled insulating cup 2 of FIG. 4 is shown. Identical references denote identical parts of the cup 2, so that a repeat description is omitted. The inner cup 16 of the FIG. 5 does not comprise a shoulder 26 below the lip 21. In order to ensure a sufficiently wide hollow space 27 between the inner sleeve 17 and the outer sleeve 1, an inwardly rolled curled part 28 is provided on the upper edge of the outer sleeve 1, which is supported on the inner sleeve 17. The curled part 3 on the lower edge of the outer sleeve 1 comprises in turn an area 15 which extends parallel to the outer sleeve 1 and is thus glued on in the area of the overlap 7 (not shown in FIG. 5) on the inner side 9. In a variation to the curled part 3 shown in FIGS. 1 and 4, the curled part 3 in FIG. 5 is not pressed flat below the area 15, but rather rolled in with an enlarged radius of curvature. The form of the curled part 3 is advantageously adapted to the stiffness and thickness of the paper material used for the outer sleeve 1.

The invention claimed is:

1. A double walled cup comprising:

an inner cup having an upper area and a lower skirt, with the lower skirt having a widening area with a diameter larger than a diameter of a portion of the upper area, a lower edge of the skirt forming a standing base for the cup; and an outer sleeve formed from a blank made of paper material and provided with an inwardly rolled curled part, whereby the blank is joined to form a tube shape by an overlap of two longitudinal edges of the blank;

wherein a lower edge of the outer sleeve is folded or rolled so that an inner side of the lower edge of the outer sleeve is placed opposite an inner side of the outer sleeve, thereby forming the curled part;

wherein the inner side of the lower edge of the curled part is glued or sealed onto the inner side of the outer sleeve at least in an area of the overlap;

wherein a smallest diameter of the curled part is smaller than a largest diameter of the widening area of the skirt; and wherein a diameter of an upper edge of the curled part is larger than the largest diameter of the widening area of the skirt; and wherein the blank comprises a recess in the area of the overlap, so that at the overlap, an area of the curled part extending parallel to the outer sleeve results in an overall thickness which corresponds only approximately to three times a material thickness of the blank.

2. The double walled cup according to claim 1, wherein a top area of the curled part is pressed flat against the inner side of the outer sleeve and a top edge of the curled part faces upward.

3. The double walled cup according to claim 1, wherein the curled part is rolled with an enlarged radius of curvature and has a top area extending parallel to the outer sleeve adjacent the enlarged radius of curvature.

4. The double walled cup according to claim 1, wherein the curled part is glued or sealed onto the inner side of the outer sleeve only at the area of the overlap.

5. The double walled cup according to claim 1, wherein the blank includes four sides comprising the two longitudinal edges and a pair of curved edges, the two longitudinal edges are straight, a first one of the straight longitudinal edges intersects each of the curved edges, a second one of the straight longitudinal edges intersects a first one of the curved edges, and the recess is located between ends of the second one of the straight longitudinal edges and a second one of the curved edges.

6. The double walled cup according to claim 1, wherein the largest diameter of the widening area is located at the lower edge of the skirt.

7. The double walled cup according to claim 1, wherein the recess is the sole recess formed in a corner of the blank.

8. A process for manufacturing a double-walled cup comprising:

providing an inner cup with an upper area and a lower skirt having a widening area that has a diameter larger than a diameter of a portion of the upper area, a lower edge of the skirt forming a standing base for the cup;

forming an outer sleeve by joining a flat-lying blank made of paper material to form a tube shape by overlapping two longitudinal edges of the blank at an overlap;

providing the outer sleeve with an inwardly rolled curled part, wherein a smallest diameter of the curled part is smaller than a largest diameter of the widening area of the skirt, and a diameter of an upper edge of the curled part is larger than the largest diameter of the widening area of the skirt;

gluing or sealing the curled part to an inner side of the outer sleeve at least in an area of the overlap;

sliding the outer sleeve on the inner cup having the widening area;

wherein the two longitudinal edges of the blank comprise a first longitudinal edge and a second longitudinal edge, with a recess being located on the first longitudinal edge, and the method further includes lying the recess in the area of the overlap; and wherein gluing or sealing the curled part to the inner side of the outer sleeve comprises gluing or sealing an inner side of a lower edge of the curled part onto the inner side of the outer sleeve only at the area of the overlap; and forming the curled part by folding or rolling the lower edge of the outer sleeve so that the inner side of the lower edge of the curled part is placed opposite the inner side of the outer sleeve.

9. The process according to claim 8, including applying a glue stripe at the second longitudinal edge of the blank before the edges of the blank are joined to form the outer sleeve.

10. The process according to claim 9, wherein, because of the recess, a part of the glue stripe is not covered when the first and second longitudinal edges are overlapped.

11. The process according to claim 10, wherein gluing or sealing the curled part to the inner side of the outer sleeve in the area of the overlap comprises gluing with the part of the glue stripe that is not covered.

12. The process according to claim 8, wherein the blank includes four sides comprising the two longitudinal edges and a pair of curved edges, the two longitudinal edges are straight, a first one of the straight longitudinal edges intersects each of the curved edges, a second one of the straight longitudinal edges intersects a first one of the curved edges, and the recess is located between ends of the second one of the straight longitudinal edges and a second one of the curved edges.

13. The process according to claim 8, wherein the largest diameter of the widening area is located at the lower edge of the skirt.

14. The process according to claim 8, wherein the recess is the sole recess formed in a corner of the blank.

* * * * *